US007234688B1

(12) United States Patent
Asenbauer

(10) Patent No.: US 7,234,688 B1
(45) Date of Patent: Jun. 26, 2007

(54) LOCKABLE HINGED FASTENER

(76) Inventor: Christopher J. Asenbauer, 6187 Wingfoot Ave., Banning, CA (US) 92220

( * ) Notice: Subject to any disclaimer, the term of this patent is extended or adjusted under 35 U.S.C. 154(b) by 0 days.

(21) Appl. No.: 11/208,210

(22) Filed: Aug. 22, 2005

Related U.S. Application Data

(60) Provisional application No. 60/604,276, filed on Aug. 25, 2004.

(51) Int. Cl.
*E04H 17/16* (2006.01)

(52) U.S. Cl. ..... 256/26; 256/65.01

(58) Field of Classification Search ..... 403/389, 403/396, 65, 79; 256/25, 26, 1, 19, 24, 47, 256/32, 49
See application file for complete search history.

(56) References Cited

U.S. PATENT DOCUMENTS

| | | | | |
|---|---|---|---|---|
| 3,521,332 | A * | 7/1970 | Kramer | 403/188 |
| 4,688,961 | A * | 8/1987 | Shioda et al. | 403/389 |
| 5,259,690 | A * | 11/1993 | Legge | 403/385 |
| 5,542,159 | A * | 8/1996 | Schultz et al. | 24/341 |
| 5,664,769 | A * | 9/1997 | Sadinsky et al. | 256/73 |
| 6,866,252 | B2 * | 3/2005 | Pulliam | 256/40 |
| 6,893,007 | B2 | 5/2005 | Asenbauer | |

* cited by examiner

*Primary Examiner*—Daniel P. Stodola
*Assistant Examiner*—Nahid Amiri
(74) *Attorney, Agent, or Firm*—William W. Haefliger

(57) ABSTRACT

A fence pole clip, comprising two clip sections, the sections having portions configured to conformingly attach to two fence poles, and means swingably interconnecting the sections between the end portions, whereby the sections can be relatively swung to allow positioning of the two clip sections and portions adjacent one of the poles.

10 Claims, 6 Drawing Sheets

100
101
101
101
101
101
10
11a
11b

LOCKABLE HINGED FASTENER

FIELD OF THE INVENTION

This application is based on provisional application Ser. No. 60/604,276, filed Aug. 25, 2004.

This invention relates generally to attachment of fence poles to one another, and more specifically to improvements in clips that have dual modes of operation, wherein in one mode a clip retains two fence poles in adjacent, stabilized relation or condition, and in a second mode the clip is folded to embrace only one of the poles and in a manner facilitating ease of wrapping of fence mesh about the one pole and clip, for storage.

BACKGROUND OF THE INVENTION

Fences installed around swimming pools commonly employ flexible mesh retained to spaced poles, as displayed for example in U.S. Pat. No. 6,893,007B2. Such poles may be upwardly removed from lower end anchorage in underground receptacles, for storage, the mesh fencing being wrapped about the poles. However, when clips are attached to adjacent poles, wrapping of fencing about such adjacent poles is difficult and produces a very bulky and clumsy package. There is need for a simple effective way to eliminate or reduce bulkiness in fence wrapped pole packages. Also there is need for an improved clip that will facilitate fence wrapping about a single pole, and in the very effective manner as discussed herein.

SUMMARY OF THE INVENTION

It is a major object to provide a simple effective solution to the problems as referred to, through provision of an improved fence pole clip. Basically, the improved clip comprises, in combination:

a) two clip sections, b) the sections having portions configured to conformingly attach to two fence poles, c) means swingably interconnecting the sections between said end portions, d) whereby the sections can be relatively swung to allow positioning of the two clip sections and portions adjacent one of the poles.

As will be seen, at least one of the clip section end portions may be arcuate to conform generally to, or embrace, a fence pole; and preferably both of the section end portions are arcuate, to embrace opposite sides of the pole.

Another object is to provide clip section end portions with elongation in the direction of axes defined by the poles, whereby the clip blocks relative cocking of the poles. In this regard, the poles themselves may advantageously define splits to receive fencing material, in the manner to be described, enhancing wrapping of fencing about poles, for storage.

Yet another object is to provide the fencing material with an upper edge band which defines a horizontal shape continuation of an upper clip that holds the poles together.

An additional object is to provide an improved clip having intermediate portions between opposite end arcuate portions, and a hinge structure interconnecting such intermediate portions in such a way that the end portions do not "cock" in use.

These and other objects and advantages of the invention, as well as the details of an illustrative embodiment, will be more fully understood from the following specification and drawings, in which:

DRAWING DESCRIPTION

DETAILED DESCRIPTION

FIGS. 2–5 and 7 show the fence pole clip 10 comprising two clip sections 10*a* and 10*b*, having end portions 10*c* and 10*d* to conformingly attach to two fence poles 11*a* and 11*b*. End portions 10*c* and 10*d* may be arcuate as shown to generally conform to curvature of the poles. The sections also have intermediate portions 10*e* and 10*f*, where 10*e* is integral with 10*c*, at corner 10*e*' and 10*f* is integral with 10*d* at corner 10*f*'. The elements 10*c*, 10*d*, 10*e* and 10*f* have interior surfaces that are flat, i.e. not curved, lengthwise of the poles to seat flatly against the poles, preventing relative cocking of the poles, i.e. relatively endwise displacement of two poles.

Figure 11:
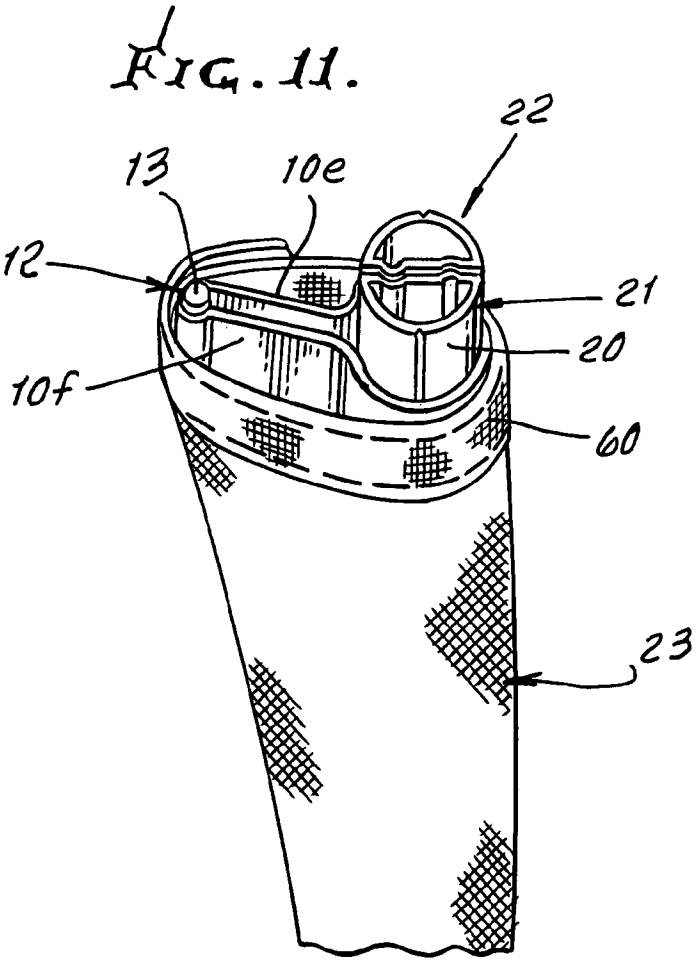
FIG. 11 is a perspective view showing fence mesh wrapped about a fence pole to which both sections of a stored clip are positioned.

Means is provided for swingably interconnecting the sections 10*a* and 10*b*, at a location between 10*c* and 10*d*; and such means may include a hinge 12 having a pivot pin 13, that projects through turned ends or tongues 14 and 15 on the respective clip sections. Typically, turned tongue 15 integral with clip section 10*b* is positioned and retained between turned tongues 14 integral with clip section 10*a*, in the direction of the axis 17 of elongation of the pin which is parallel to the pole axes. Accordingly, the clip sections can be relatively swung from FIG. 3 position to allow positioning of the two clip section end portions 10*c* and 10*d* adjacent or adjacent only one of the poles. See for example FIG. 4, wherein section 10*b* has been swung into an alternate position, adjacent a side 20 of pole 21 that is opposite the pole side 22, allowing the fence mesh 23 to be easily wrapped about pole 21 and about the folded clip, as seen in FIG. 11. A fastener or fasteners 24 attaches clip section 10*a* to side 22 of pole 21.

Figure 3:
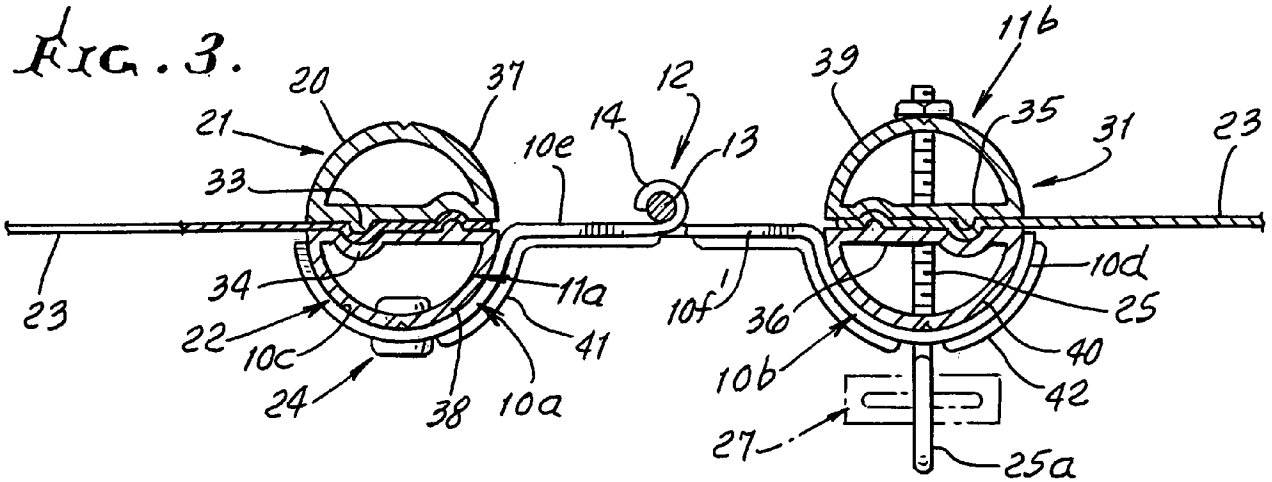
FIG. 3 is a top plan view taken on lines 3—3 of FIG. 2.
Figure 4:
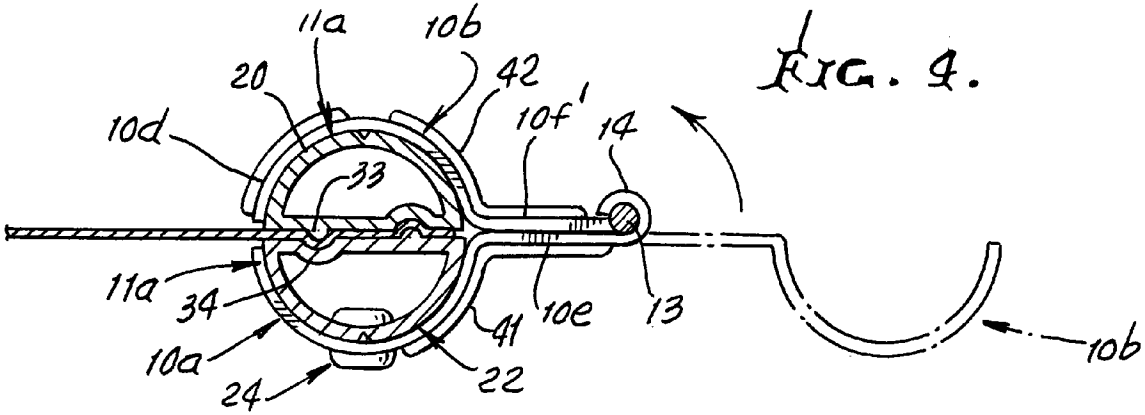
FIG. 4 is a view like FIG. 3 but showing the clip with one section rotated into stored position at a side of one pole opposite the other clip section.
Figure 7:
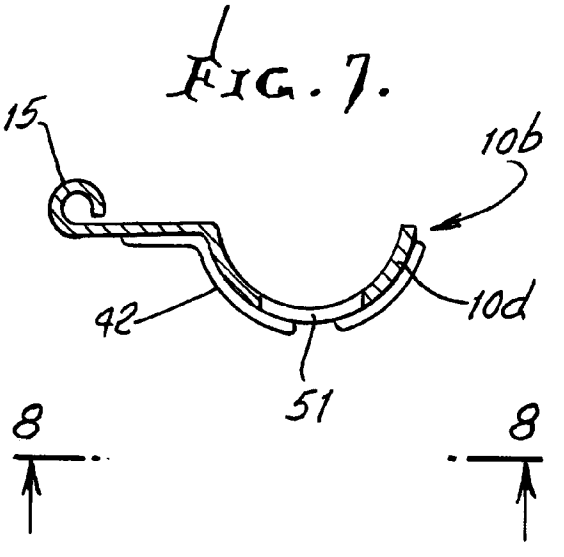
FIG. 7 is a top plan view of the other clip section.
Figure 8:
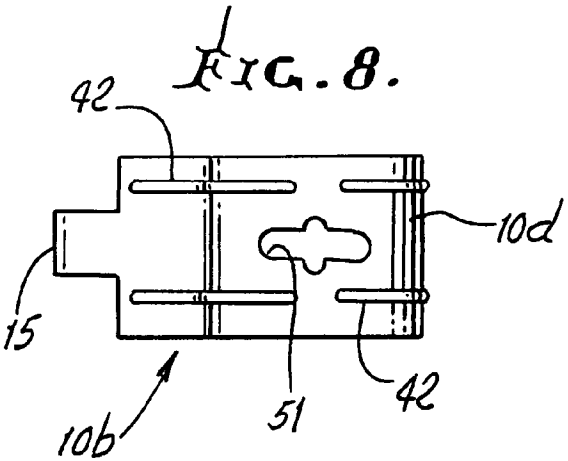
FIG. 8 is a side view taken on lines 8—8 of FIG. 7.
Figure 5:
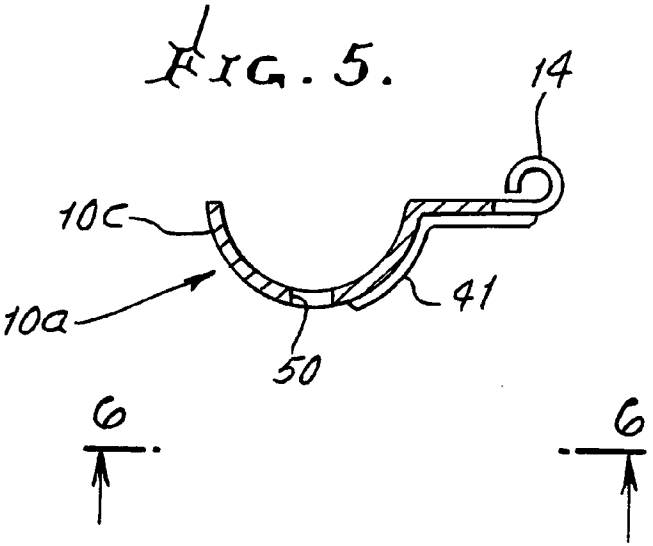
FIG. 5 is a top plan view of one clip section.
Figure 6:
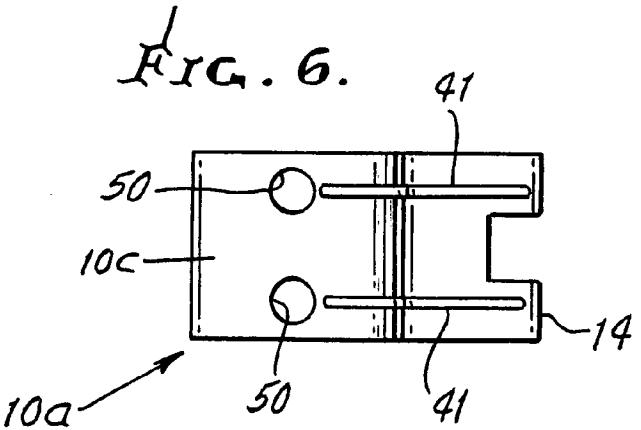
FIG. 6 is a side view taken on lines 6—6 of FIG. 5.
Figure 10:
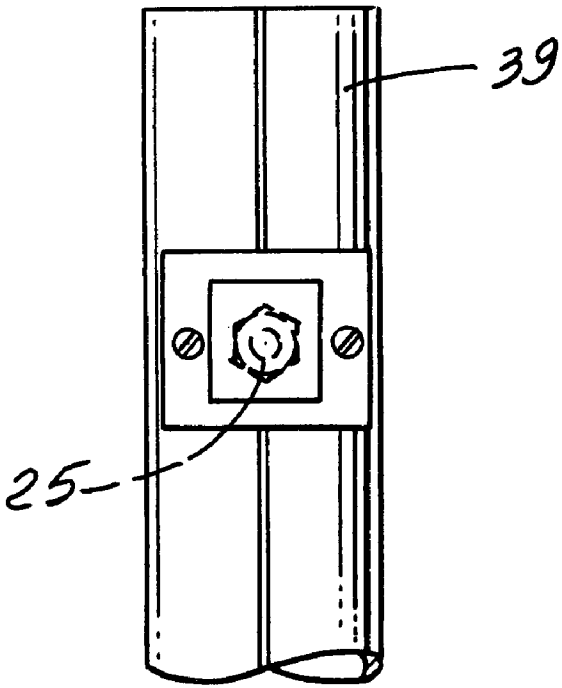
FIG. 10 is a side view taken on lines 10—10 of FIG. 9.
Figure 9:
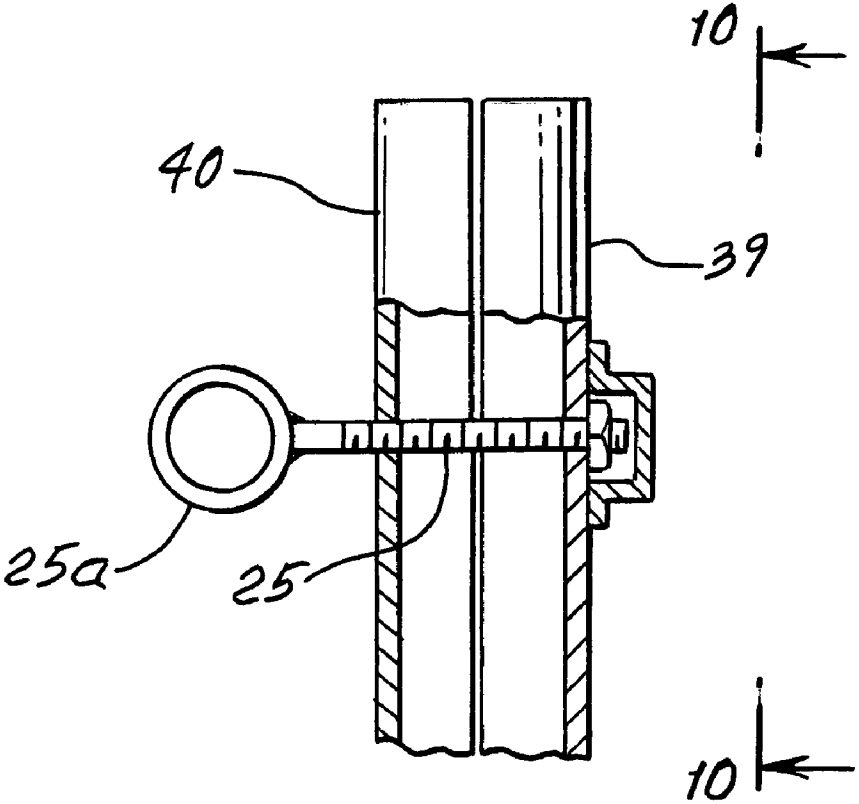
FIG. 9 is a section showing a retainer for holding two sections of a pole in assembled relation.
Figure 12:
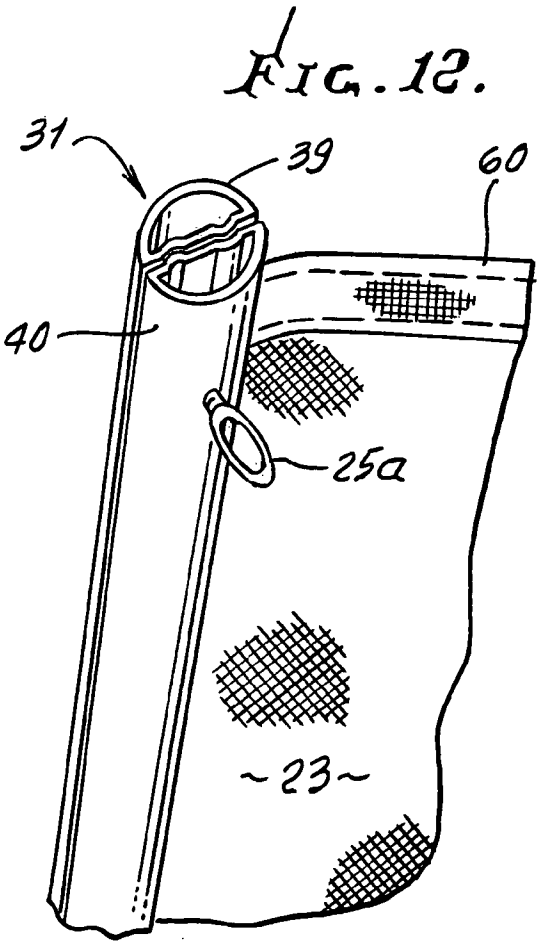
FIG. 12 is a perspective view of a portion of a double section pole, to which fence mesh is retained.

FIG. 3 also shows a fastener 25 removably attaching the clip section 10*b* to an adjacent pole 31, with the clip in extended position, prior to release of that fastener allowing swinging of section 10*b*. See also clip portions 10*e* and 10*f* in aligned relation. Fastener 25 has an external end portion 25*a*, with an eye bolt opening for arm 27*a* of a padlock 27. The poles 21 and 31 may each have split configuration, with two semi-circular pole sections having interfit at tongue and groove interior connections 33 and 34, allowing gripping of fence mesh or webbing 23.

Figure 1:
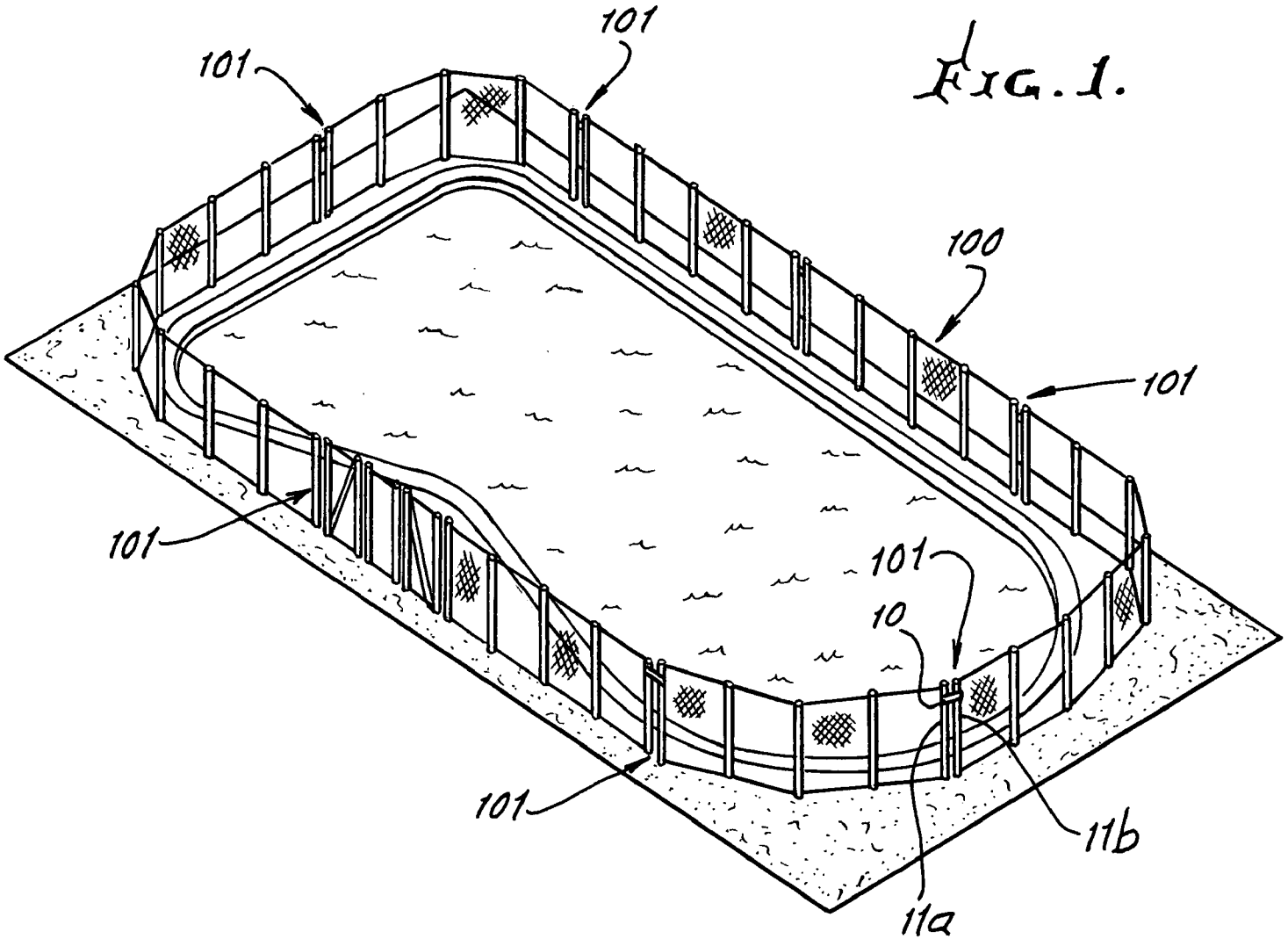
FIG. 1 is a perspective view of a fenced area, showing pairs of fence poles positioned to be connected together in side-by-side relation.
Figure 2:
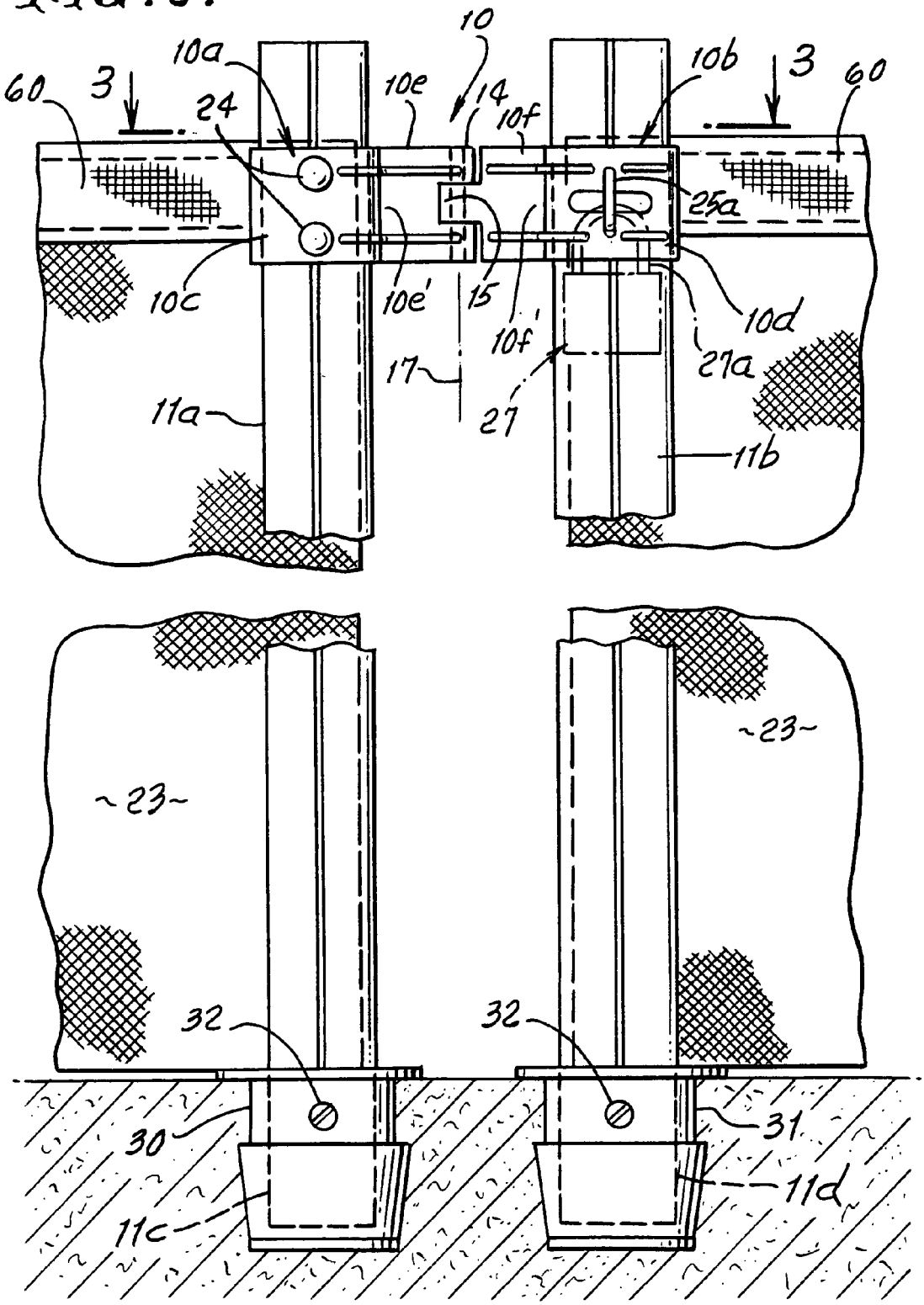
FIG. 2 is an enlarged side view showing two poles connected together by a clip having two relatively movable sections each section connected to a pole.

FIGS. 1 and 2 show the pole bottom ends 11*c* and 11*d* received in underground anchor tubes 30 and 31, for holding the poles in stabilized upright positions. Fasteners 32 attach the poles to the anchors.

The illustrated split poles have interior cross pieces 35 and 36 carrying the interfitting tongue and groove elements 33 and 34, for providing rigidity of pole sections 37 and 38, and 39 and 40 and for gripping of fencing material 23. Strengthening ribbing is provide on the clips, as at 41 and 42, and extends over the intermediate and arcuate end portions of the clips.

FIGS. 5–8 show openings 50 and 51 in the clip curved end portions to receive pole attachment fasteners, as referred to.

The fence mesh may have an upper strengthening band 60, extending horizontally at the level of the clip, for structural and/or visual continuity. See FIG. 2.

The complete fence is shown at 100, in FIG. 1. Clipped together poles are shown at spaced apart locations 101, to provide fence stability along the fence length.

I claim:

1. A fence pole clip system, comprising in combination:

a) two substantially parallel fence poles, and two clip sections, b) the sections having end portions conformingly attached to two said fence poles, c) means located between the poles and swingably interconnecting the sections between said end portions, about an axis parallel to the poles, d) whereby the sections can be relatively swung to allow positioning of said two clip sections and portions adjacent only one of the poles, e) each of said section end portions being approximately semi-cylindrically arcuate to conform to a pole surface which is also arcuate, f) said poles having interior cross pieces to retain a fence fabric, and wherein each of the clip sections includes an intermediate portion located between the poles and extending in a plane substantially parallel to planes defined by said pole interior cross pieces, g) said end portions being perforated at semi-circular crest locations furthest from said interior cross pieces receiving clip-to-pole connectors, whereby removal of one of said connectors from connected relation to and completely through a respective pole allows swinging of the respective clip section for positioning adjacent the other pole.

2. The system of claim 1 wherein said section end portions are elongated in the direction of axes defined by the poles, whereby the clip section and portions block relative cocking of the poles.

3. The system of claim 1 wherein said section end portions have semi-cylindrical concave surfaces engaging the poles lengthwise thereof to block relative cocking of the poles.

4. The system of claim 1 wherein the poles define lengthwise splits to receive a fencing fabric interiorly of the poles, the fabric clamped in a plane facing toward an arcuate clip section.

5. The system of claim 1 wherein the poles define lengthwise splits to receive said fencing fabric adjacent said cross pieces.

6. The system of claim 1 wherein the connectors comprise removable fasteners connecting the clip sections end portions to the poles, said one connector passing completely through said one pole and said cross pieces thereof.

7. The system of claim 1 wherein the poles have opposite sides adjacent which said clip section end portions are alternatively closely positioned, as accommodated by hinging provided by said means.

8. The system of claim 1 wherein said means comprise a hinge.

9. The system of claim 7 wherein said means comprise a hinge.

10. The system of claim 1 including stiffening ribbing integral with said sections and extending directionally lengthwise of the clip.

* * * * *